US008480082B2

(12) United States Patent
Kannari et al.

(10) Patent No.: US 8,480,082 B2
(45) Date of Patent: Jul. 9, 2013

(54) IMAGE FORMING APPARATUS

(75) Inventors: Isao Kannari, Kashiwa (JP); Takeshi Suga, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 13/164,932

(22) Filed: Jun. 21, 2011

(65) Prior Publication Data

US 2012/0008998 A1 Jan. 12, 2012

(30) Foreign Application Priority Data

Jul. 7, 2010 (JP) ..... 2010-154960

(51) Int. Cl.
*B65H 9/04* (2006.01)
*B65H 3/06* (2006.01)

(52) U.S. Cl.
USPC ..... 271/242; 271/118; 271/10.12; 271/127

(58) Field of Classification Search
USPC ..... 271/242, 118, 127, 10.12
See application file for complete search history.

(56) References Cited

U.S. PATENT DOCUMENTS

| | | | | |
|---|---|---|---|---|
| 4,023,792 | A * | 5/1977 | Punnett et al. | 271/22 |
| 5,253,854 | A * | 10/1993 | Tanoue et al. | 271/10.12 |
| 5,386,983 | A * | 2/1995 | Ando | 271/118 |
| 6,260,840 | B1 * | 7/2001 | Suga et al. | 271/10.12 |
| 6,354,584 | B1 * | 3/2002 | Suga et al. | 271/10.12 |
| 6,382,622 | B1 * | 5/2002 | Takada et al. | 271/122 |
| 6,536,759 | B1 * | 3/2003 | Takada | 271/125 |
| 6,609,707 | B1 * | 8/2003 | Yano | 271/10.05 |

FOREIGN PATENT DOCUMENTS

JP 11-343050 A 12/1999

* cited by examiner

*Primary Examiner* — Luis A Gonzalez
(74) *Attorney, Agent, or Firm* — Canon USA, Inc., IP Division

(57) ABSTRACT

A sheet is fed to a registration roller pair by a separation-feeding unit formed by a sheet feeding roller and a separation portion, and is caused to abut a nip portion of the registration roller pair at rest to form a loop in the sheet. Then, when the registration roller pair rotates at a predetermined timing to convey the sheet, a pressurization plate is raised again to bring the sheet into press contact with the sheet feeding roller to thereby impart a conveyance force to the sheet, making it possible to feed the sheet reliably to the registration roller pair.

8 Claims, 9 Drawing Sheets

INITIAL STATE

PRESSURIZATION COMPLETED

SHEET FEEDING START

PRESSURIZATION RELEASED

PRE-REGISTRATION SENSOR ON

REGISTRATION LOOP FORMATION AND MIDDLE PLATE PRESSURIZATION COMPLETED

CONVEYANCE START BY IMAGE FORMATION SYNCHRONOUS SIGNAL

PRESSURIZATION RELEASED

SHEET TRAILING EDGE HAS PASSED THROUGH SHEET FEEDING UNIT

IMAGE FORMING APPARATUS

BACKGROUND OF THE INVENTION

1. Field of the Invention

The present invention relates to an image forming apparatus equipped with a sheet feeding apparatus configured to feed a sheet to an image forming unit.

2. Description of the Related Art

Conventionally, an image forming apparatus such as a printer or a copying machine is equipped with a sheet feeding apparatus for supplying sheets one by one to an image forming unit from a tray on which the sheets are stacked.

Generally speaking, between the sheet feeding apparatus and a registration roller pair for correcting skew feed and feeding out a sheet in synchronization with an image to be formed in the image forming unit, there is arranged a draw roller for conveying the sheet fed from the sheet feeding apparatus. However, to achieve a reduction in the size of the apparatus as a whole, there has been proposed a construction in which the registration roller pair is arranged immediately downstream of the sheet feeding apparatus without providing any draw roller. This technique is discussed in Japanese Patent Application Laid-Open No. 11-343050.

FIG. 9 illustrates an example of this sheet feeding apparatus. In FIG. 9, a sheet feeding apparatus has a sheet feeding tray 71, on which sheets S are stacked, and a vertically rotatable pressurization plate 70 provided at the forward end of the sheet feeding tray 71 is held down by a cam (not illustrated) against the elastic force of springs 72*a* and 72*b*.

When the sheet feeding apparatus receives a feeding signal from a control unit (not illustrated), the cam rotates, and the pressurization plate 70 is rotated upwardly in FIG. 9 by the springs 72*a* and 72*b*, and the leading edge of the sheet bundle is brought into press contact with a sheet feeding roller 51. In this state, the sheet feeding roller 51 is rotated, thereby feeding the uppermost sheet.

When a plurality of sheets are fed in an overlapped state, the sheets are separated from each other by a separation roller 53 held in press contact with the sheet feeding roller 51 by a spring 56.

Here, after a sheet has reached a nip portion (press contact portion) formed by the sheet feeding roller 51 and the separation roller 53, a pressurization plate 70 is rotated downwards in FIG. 9 by a cam (not illustrated), thereby separating the stacked sheets S and the sheet feeding roller 51 from each other.

As a result, it is possible to effectively separate double-fed sheets from each other. In other words, if the sheets on the pressurization plate 70 are kept in press contact with the sheet feeding roller 51, the leading end of the stacked sheet bundle is brought into press contact with the sheet feeding roller 51 and the pressurization plate 70, so that the next sheet may be drawn out due to the frictional force between sheets.

In view of this, the pressurization plate 70 is rotated downward, whereby the stacked sheet bundle is not pressed against the sheet feeding roller 51, and it is possible to reduce the possibility of the next sheet being drawn out due to frictional force, thus making it possible to feed the sheets in a state in which they are reliably separated from each other.

On the downstream in the sheet conveyance direction of the sheet feeding apparatus, there is provided a registration roller pair 57 for feeding a sheet to an image forming unit in a synchronized manner to correct skew feed of the sheet and to effect registration between the sheet and an image formed in the image forming unit (not illustrated).

The sheet fed by the sheet feeding roller 51 is conveyed with its leading edge directed to the nip portion of the registration roller pair 57 at rest, and the leading edge abuts the nip portion to form a loop of a predetermined amount in the sheet, whereby skew feed of the sheet is corrected. And, the registration roller pair 57 is rotated by an image leading edge synchronous signal issued from a control unit (not illustrated), whereby the sheet enters the nip portion of the registration roller pair 57 to be conveyed toward the image forming unit.

In the sheet feeding apparatus illustrated in FIG. 9, after a loop of a predetermined amount has been formed in the sheet between the sheet feeding roller 51 and the registration roller pair 57, if an attempt is made to cause the sheet to enter the nip portion through rotation of the registration roller pair 57, the sheet sometimes may be prevented from entering the nip portion.

This may be due to the fact that, when the sheet is caused to abut the nip portion of the registration roller pair 57 to form a loop, the separation roller 53 is pushed down in the FIG. 9 away from the sheet feeding roller 51 due to the rigidity of the sheet. More specifically, the separation roller 53 is pushed down by the force restoring the looped and deflected sheet to the former state, whereby the press contact force between the sheet and the sheet feeding roller 51 is weakened, with the result that slippage occurs between the sheet feeding roller 51 and the sheet, making it impossible to obtain the requisite conveyance force.

In particular, this is more likely to occur in the case where a sheet of high rigidity such as an envelope is conveyed since the force with which the separation roller 53 is pushed down is then further increased.

SUMMARY OF THE INVENTION

The present invention is directed to an image forming apparatus capable of reducing generation of defective sheet conveyance at the registration roller pair with the construction using no draw roller.

According to an aspect of the present invention, an image forming apparatus including a sheet feeding apparatus which feeds the sheet and an image forming unit which forms an image to the sheet fed out from the sheet feeding apparatus, the image forming apparatus, the image forming apparatus includes a sheet stacking portion where sheets are stacked, a separation-feeding unit configured to separation-feed the sheets stacked on the sheet stacking portion, a conveyance force imparting unit configured to impart a conveyance force to the sheets on the upstream in the sheet feeding direction of the separation-feeding unit, a registration roller pair arranged on the downstream in the sheet feeding direction of the separation-feeding unit and configured to feed out a sheet to the image forming unit with a predetermined timing after temporarily stopping the sheet, with its leading edge abutting a nip portion, and a control unit configured to control the operation of the separation-feeding unit, of the conveyance force imparting unit, and of the registration roller pair, wherein the control unit performs control such that after the conveyance force imparting unit has applied a conveyance force to the sheet to cause it to enter the separation-feeding unit, the imparting of the conveyance force to the sheet by the conveyance force imparting unit is stopped, that the sheet is conveyed to the registration roller pair at rest by the separation-feeding unit to cause the leading edge of the sheet to abut the nip portion, and that when the registration roller pair starts to rotate, the sheet is fed again by the separation-feeding unit, with the conveyance force being imparted to the sheet by the conveyance force imparting unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

First, the construction of a printer as an example of an image forming apparatus equipped with a sheet feeding apparatus according to an exemplary embodiment of the present invention will be schematically described with reference to FIG. 8.

Figure 8:
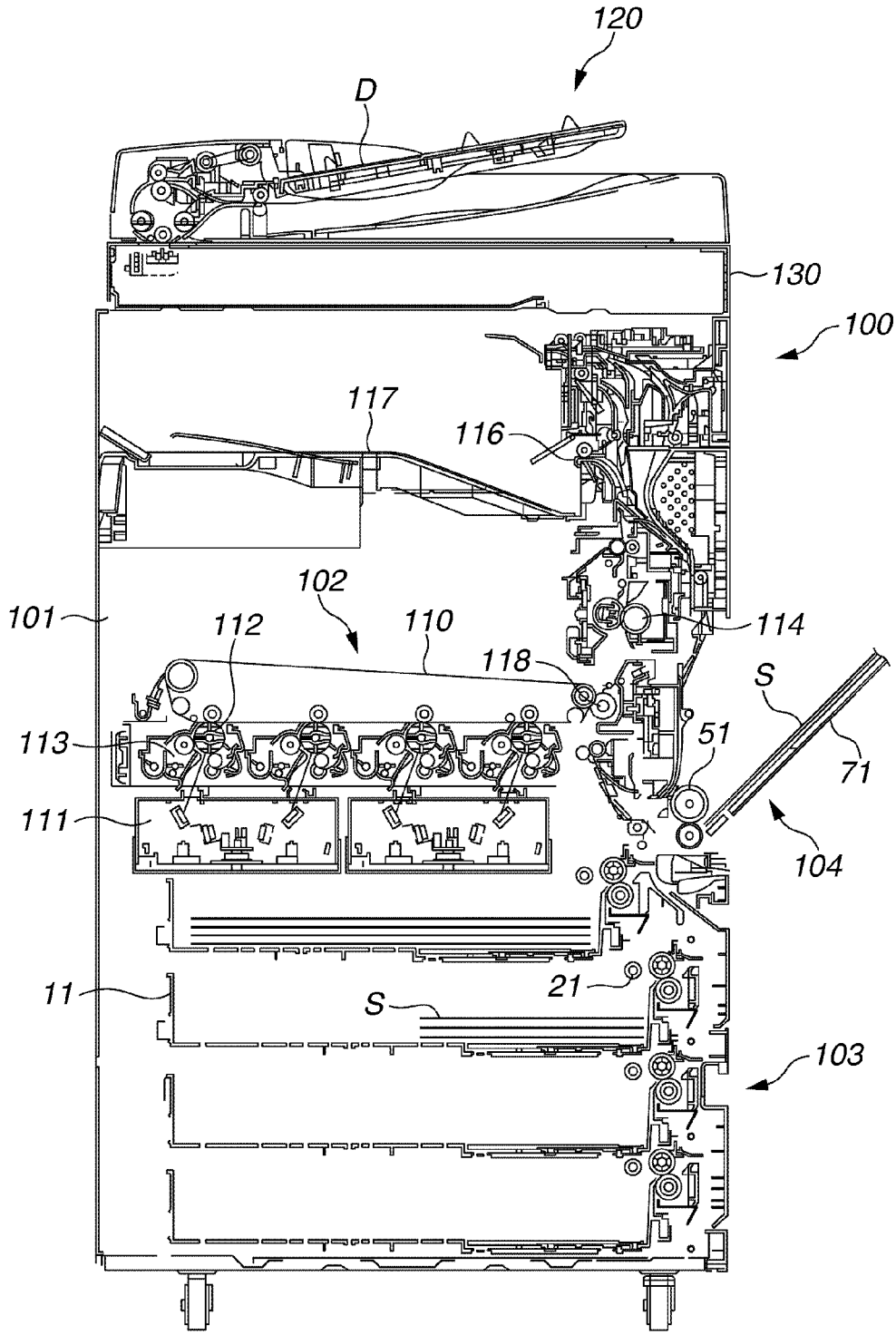
FIG. 8 is a schematic diagram illustrating the construction of a printer as an example of an image forming apparatus equipped with a sheet feeding apparatus according to exemplary embodiments of the present invention.
Figure 9:
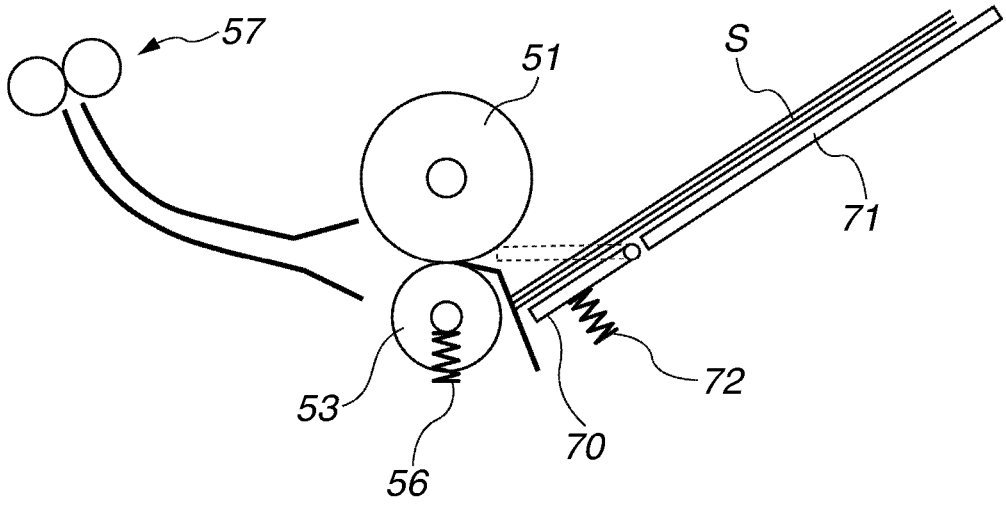
FIG. 9 is a sectional view of a conventional sheet feeding apparatus.

In FIG. 8, a printer 100 includes a printer main body. In the upper portion of the printer main body 101, there are provided an auto document feeder 120 configured to automatically feed a document D, and an image reading unit 130 configured to read the document D placed on a platen glass. Further, inside the printer main body 101, there are provided an image forming unit 102, and sheet feeding apparatuses 103 and 104 configured to feed a sheet S to the image forming unit 102.

In the image forming unit 102, there are provided a laser scanner unit 111, photosensitive drums 112 for transferring toner images to the outer periphery of an intermediate transferring belt 110, and developing devices 113 for forming toner images on the photosensitive drums 112.

The sheet feeding apparatus 103 is equipped with a plurality of sheet storage unit 11 detachable with respect to the printer main body 101 and configured to accommodate sheets S, sheet feeding rollers 21 configured to feed out the sheets S accommodated in the sheet storage unit 11.

Further, the sheet feeding apparatus 104 is equipped with a sheet feeding tray 71 on which the sheets S are stacked, a sheet feeding roller 51 configured to feed out the sheets S stacked on the sheet feeding tray 71. The sheet feeding apparatus 104 is a so-called multi-feeding apparatus, in which the user sets a desired sheet to be fed on the sheet feeding tray 71 that is protruding from a side of the image forming apparatus.

Next, the image forming operation of the printer 100, constructed as described above, will be described.

When an image reading signal is output to the image reading unit 130 from a control unit (not illustrated) provided in the printer main body 101, an image is read by the image reading unit 130. After this, a laser beam corresponding to this electric signal is applied to the photosensitive drum 112 from the laser scanner unit 111.

At this time, the photosensitive drum 112 has been previously charged, and an electrostatic latent image is formed through irradiation of light, next, the electrostatic latent image is developed by the developing device 113, whereby a toner image is formed on the photosensitive drum 112. And, the toner image thus formed is primarily transferred to the outer periphery of the intermediate transferring belt 110, whereby a toner image is formed on the intermediate transfer belt 110.

On the other hand, when a sheet feeding signal is output from the control unit to the sheet feeding apparatuses 103 and 104, a sheet S is supplied from the sheet storage unit 11 constituting the sheet accommodation portion or from the sheet feeding tray 71. After this, the sheet S is fed by the registration rollers to a transfer unit formed by the intermediate transferring belt 110 and a secondary transfer roller 118 in synchronization with the toner image on the intermediate transferring belt 110.

Next, the toner image is transferred to the sheet fed to the transfer unit, and, after this, the sheet is conveyed to a fixing unit 114, where it undergoes heating and pressurization, whereby the transfer image, which has not been fixed, is fixed to the sheet S. And, the sheet to which the image has been thus fixed is discharged onto a discharge tray 117 from the printer main body 101 by a discharge roller 116.

Figure 2:
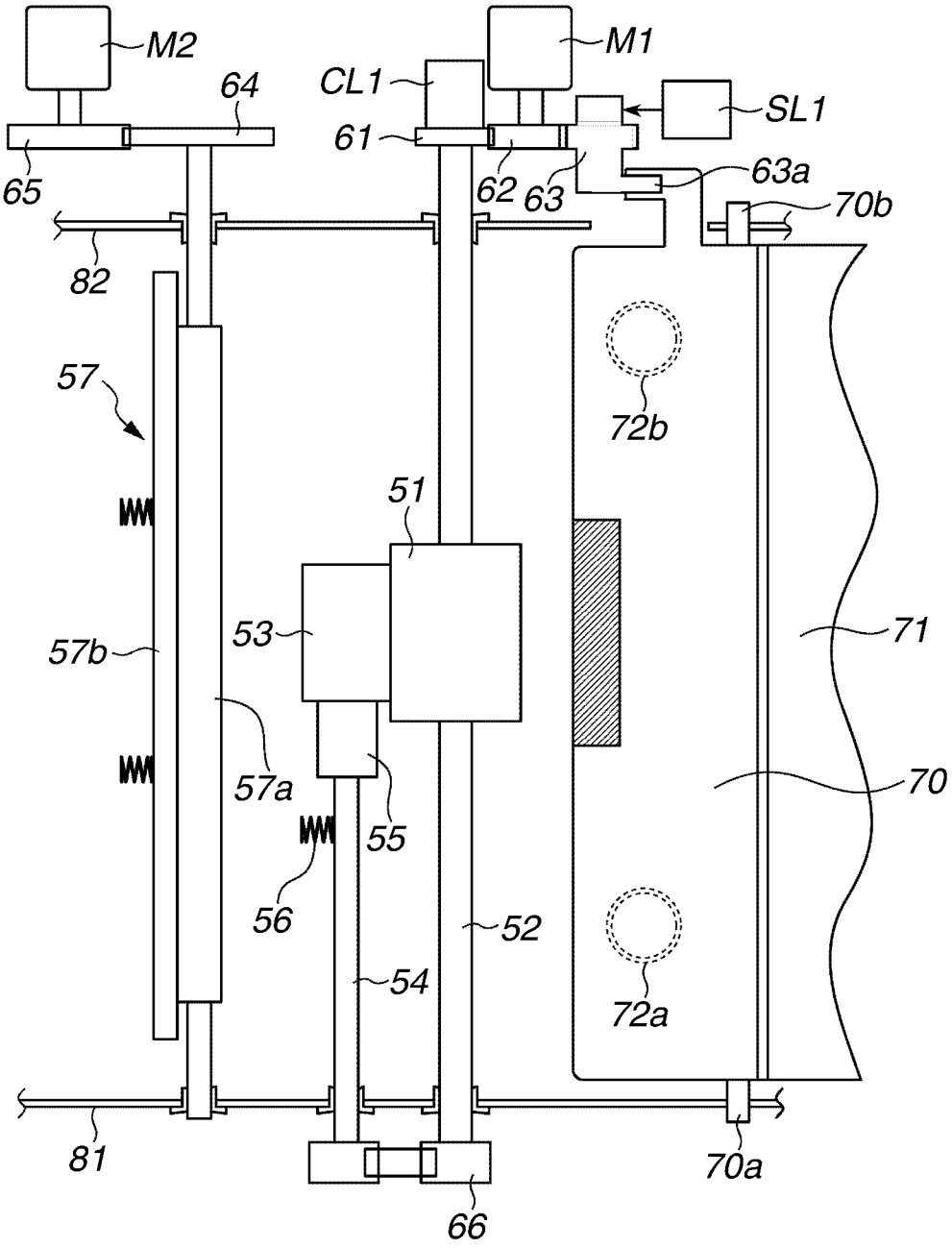
FIG. 2 is a developed view of the driving mechanism of the sheet feeding apparatus according to the first exemplary embodiment of the present invention.

Next, the sheet feeding apparatus 104 according to the first exemplary embodiment of the present invention will be described in detail. FIG. 2 is a developed view of the driving mechanism of the sheet feeding apparatus 104 according to the first exemplary embodiment.

The printer main body 101 is equipped with the sheet feeding tray 71, which serves as a sheet stacking portion on which a sheet bundle S is stacked and supported. A pressurization plate 70, which serves as a sheet support portion, is provided so as to be swingable, using fulcrum portions 70*a* and 70*b* as the fulcrum, and the pressurization plate 70 is urged clockwise so as to pressurize the sheet feeding roller 51 by springs 72*a* and 72*b*.

Figure 1:
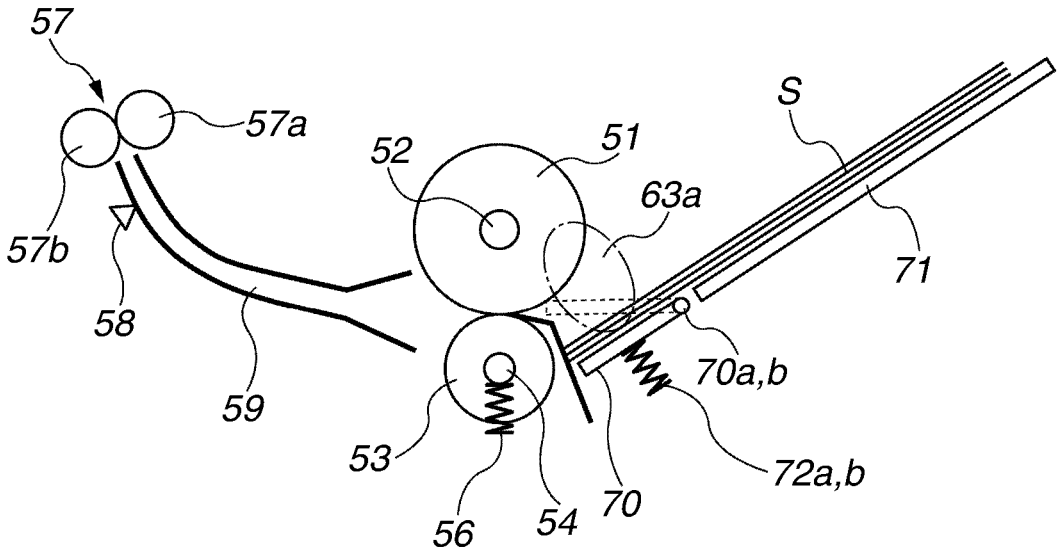
FIG. 1 is a sectional view of a sheet feeding apparatus according to a first exemplary embodiment of the present invention.

Here, by virtue of a pressurization/separation unit described below, the supported sheet S is brought into press contact with the sheet feeding roller 51 (the state indicated by a broken line in FIG. 1) or is brought out of press contact therewith (the state indicated by a solid line in FIG. 1) as appropriate.

The sheet feeding roller 51 is fixed to a support shaft 52, and the support shaft 52 is rotatably supported by a front side plate 81 and a rear side plate 82. Further, an electromagnetic clutch CL1 is provided at the back side end portion of the support shaft 52, making it possible to cut off driving transmitted from a sheet feeding motor M1 via gears 61 and 62.

Next, a construction for raising and lowering the pressurization plate 70 will be described. The gear 62 is provided so as to be capable of meshing with the gear 63, which is a partially untoothed gear. Further, the gear 63 is integrally provided with a cam 63*a* for bringing the sheet supported by the pressurization plate 70 into or out of press contact with the sheet feeding roller 51. Here, the springs 72*a* and 72*b* and the cam 63*a* constitute the pressurization unit of the present invention.

In the state in which the sheet is not being fed, a solenoid SL1 regulates the gear 63 such that the toothed portion of the gear 63 is situated opposite to the gear 62. In this state, the pressurization plate 70 is pushed down by the cam 63*a*, and the sheet on the pressurization plate 70 is spaced apart from the sheet feeding roller 51.

When sheet feeding is to be started, the solenoid SL1 is turned ON for time T1 (sec), whereby the regulation of the gear 63 is released, and the gear 63 and the gear 62 mesh with each other to transmit rotation, so that the cam 63*a* is separated from the pressurization plate 70, and the sheet is brought into press contact with the sheet feeding roller 51.

Further, through rotation of the cam 63*a*, the pressurization plate 70 is pushed down again, and the sheet and the sheet feeding roller 51 are separated from each other. In this way, one-rotation control is effected so that the sheet and the sheet feeding roller 51, which have been out of press contact with each other, are brought into press contact with each other, and brought out of press contact with each other again.

A gear 66 is fixed to the drive shaft of the sheet feeding roller 51, and driving is transmitted to a separation roller drive shaft 54 via the gear 66. Here, the drive row is formed so that the sheet feeding roller 51 rotates so as to convey the sheet S (clockwise in FIG. 1) and the separation roller drive shaft 54 rotates reverse to the sheet feeding direction (clockwise in FIG. 1).

Further, on the separation roller drive shaft 54, a separation roller 53, which is a separation portion, is rotatably provided via a torque limiter 55 configured to generate a predetermined torque. The separation roller 53 is provided opposite to the sheet feeding roller 51, and is held in press contact with the sheet feeding roller 51 with a predetermined separation pressure by a spring 56, with a bearing (not illustrated) being provided therebetween. The sheet feeding roller 51 and the separation roller 53 constitute the separation and feeding unit of the present invention.

The torque value of the torque limiter 55 and the spring 56 of the separation roller 53 are set as follows. In the state in which there exists only one sheet or no sheet at all in the nip portion (press contact portion) formed by the sheet feeding roller 51 and the separation roller 53, the separation roller 53 follows the sheet feeding roller 51 due to frictional force.

In the case where there exist two or more sheets in the nip portion, the separation roller 53 makes reverse rotation to generate a returning force for returning the sheets. Due to this construction, the sheets are fed out one by one by the sheet feeding roller 51 and the separation roller 53.

In the printer main body 101, on the downstream in the sheet feeding direction of the sheet feeding roller 51, there is provided a registration roller pair 57 for temporarily stopping the sheet, correcting skew feed, and feeding it out to the image forming unit with proper timing.

The drive shaft of a driving roller 57*a* of the registration roller pair 57 is rotatably supported by a front plate 81 and a rear plate 82, and the driving of a registration motor M2 is transmitted via gears 64 and 65. A driven roller 57*b* of the registration roller pair 57 is held in press contact with the driving roller 57*a* by a spring.

Further, in the vicinity of and on the upstream in the sheet conveyance direction of the registration roller pair 57, there is provided a pre-registration sensor 58 configured to detect passage of a sheet. A conveyance path 59 from the sheet feeding roller 51 to the registration roller pair 57*a*, 57*b* is curved.

Further, the distance from the sheet feeding roller 51 to the registration roller pair 57*a*, 57*b* as measured along the curved conveyance path 59 is set shorter than the length in the sheet conveyance direction of a sheet of the minimum size that can be used in the image forming apparatus. This helps to achieve a reduction in apparatus size.

Figure 4:
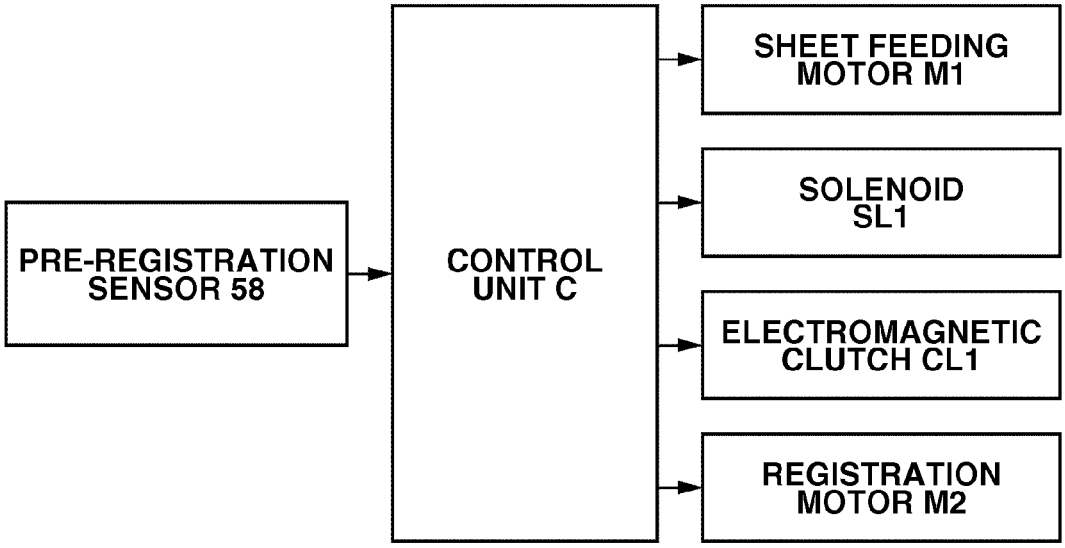
FIG. 4 is a control block diagram of the sheet feeding apparatus according to the first exemplary embodiment of the present invention.

FIG. 4 is a control block diagram of the present exemplary embodiment. To a control unit C, a signal from a start button (not illustrated) and a detection signal from the pre-registration sensor 58 are input. Further, the control unit C controls the sheet feeding motor M1, the solenoid SL1, the electromagnetic clutch CL1, and the registration motor M2.

The pressurization plate 70, the spring 56, the solenoid SL1, the cam 63*a* constitute the conveyance force imparting unit according to the first exemplary embodiment of the present invention.

Referring to FIGS. 3A to 3I and FIG. 5, the operation of feeding a sheet from the sheet feeding apparatus 104 and the registration roller pair 57 will be described. The control by the control unit C will be described with reference to the flowchart of FIG. 5.

Figure 3A:
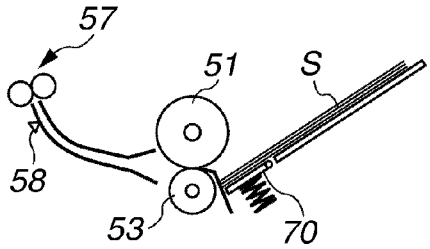
FIGS. 3A to 3I are diagrams illustrating the operation of the sheet feeding apparatus according to the first exemplary embodiment of the present invention.

In step S1, when a start button (not illustrated) is depressed, with sheets S stacked on the sheet feeding tray 71 as illustrated in FIG. 3A, the control unit C starts rotation of the sheet feeding motor M1. Next, in step S2, the control unit C turns ON the solenoid SL1 for a time T1 (sec) to start one-rotation control on the gear 63 and a cam 63*a* integrally provided on the gear 63.

Figure 3B:
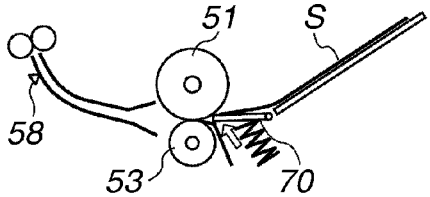
Figure 3C:
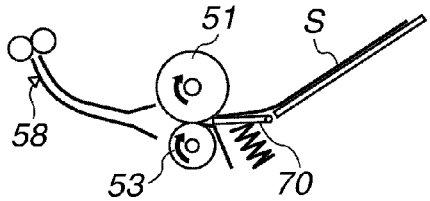

As illustrated in FIG. 3B, through this operation, a sheet S supported on the pressurization plate 70 is brought into press contact with the sheet feeding roller 51. In step S3, in this state, the control unit C turns on the electromagnetic clutch CL1, and, as illustrated in FIG. 3C, the sheet feeding roller 51 starts to feed the sheet S.

Figure 3D:
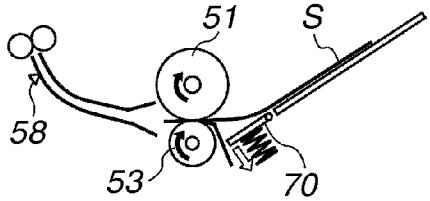

Further, as illustrated in FIG. 3D, through the one-rotation control on the cam 63*a*, the pressurization plate 70 is pushed down, and the pressurization on the sheet feeding roller 51 feeding out the sheet S is released. The number of teeth of the gear 63 and the configuration of the cam 63*a* are determined so that, after the sheet S has entered the nip portion (press contact portion) of the sheet feeding roller 51 and the separation roller 53, the pressurization by the pressurization plate 70 on the sheet feeding roller 51 feeding out the sheet is released.

In this way, after the sheet S has entered the nip portion of the sheet feeding roller 51 and the separation roller 53, the press contact of the sheet being fed out with the sheet feeding roller 51 due to the pressurization plate 70 is released, so that, as in the prior art, it is possible to return any double-fed sheets through reverse rotation of the separation roller 53.

Through the above operation, the sheet S is conveyed by the sheet feeding roller 51 toward the nip portion of the registration roller pair 57 at rest.

Figure 3E:
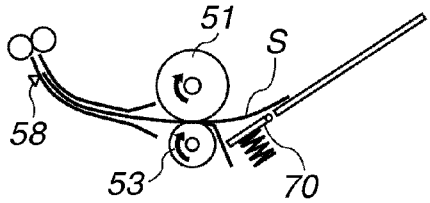

As illustrated in FIG. 3E, in the vicinity on the upstream of the registration roller pair 57, there is arranged the pre-registration sensor 58, and, in step S4, the leading edge of the sheet S that has been conveyed is detected. When the leading edge of the sheet is detected by the pre-registration sensor 58, the solenoid SL1 is turned ON in step S5, and the rotation of the sheet feeding motor M1 is transmitted to the cam 63*a*, thereby releasing the pushing-down of the pressurization plate 70. As a result, the pressurization plate 70 is pushed up by the springs 72*a* and 72*b*, and the sheet is brought into press contact with the sheet feeding roller 51 by the pressurization plate 70.

On the other hand, in step S6, the sheet feeding roller 51 is kept rotating until a predetermined time has elapsed after the detection of the leading edge of the sheet by the pre-registration sensor 58, whereby the trailing edge of the sheet is fed even after the leading edge of the sheet has abutted the nip portion of the registration roller pair 57 at rest to stop the sheet temporarily. Thus, in steps S6 and S7, a loop is formed in the sheet on the upstream of the registration roller pair 57, and the sheet feeding motor M1 is stopped.

In this connection, the timing at which the solenoid SL1 is turned ON is set so that the timing at which the solenoid SL1 is turned ON to cause the sheet to be brought into press contact with the sheet feeding roller 51 by the pressurization plate 70, is substantially the same as the timing at which the sheet feeding roller 51, which has formed a loop in the sheet, is stopped.

It is also possible for the sheet on the pressurization plate 70 to be brought into contact with the sheet feeding roller 51 a little bit earlier than the stopping of the sheet feeding roller 51. As a result, the sheet feeding roller 51 is stopped, with the sheet stacked on the pressurization plate 70 held in press contact with the sheet feeding roller 51, and the sheet is waiting for the start of the driving of the registration roller pair 57.

Due to this setting of the timing, at the rotation start of the registration motor M2, the pressurization plate 70 brings the sheet S being conveyed into press contact with the sheet feeding roller 51.

Figure 3F:
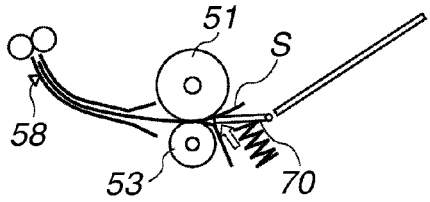

As illustrated in FIG. 3F, due to this control, at the time of loop formation, the sheet S supported by the pressurization plate 70 is brought into press contact with the sheet feeding roller 51.

Figure 3G:
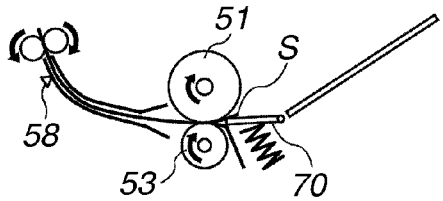

Then, in step S8, an image leading edge synchronization signal is issued from a secondary transfer roller 118 or a laser scanner unit 111 for performing image exposure, and, in step S9, the rotation of the sheet feeding motor M1 and of the registration motor M2 is started again, as illustrated in FIG. 3G. As a result, the registration roller pair 57 rotates to convey the sheet, and the sheet feeding roller 51 starts to feed the sheet S again.

Figure 3H:
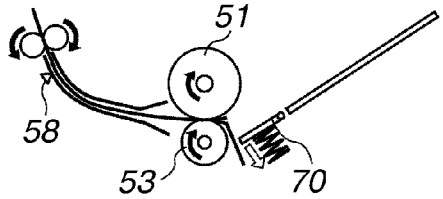

Further, as illustrated in FIG. 3H, through one-rotation control of the cam 63*a*, the press contact of the sheet S with the sheet feeding roller 51 due to the pressurization plate 70 is released after the conveyance by a predetermined amount. As a result, no double feeding occurs, in which the sheet to be fed out and the next sheet are drawn out together due to a frictional force.

Figure 3I:
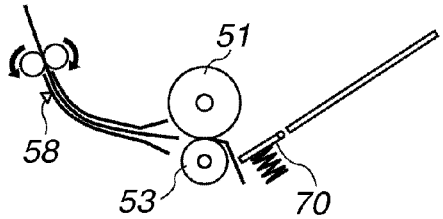

In step S10, a predetermined time T2 (sec) has elapsed since the re-feeding of the sheet S, and, in step S11, the electromagnetic clutch CL1 is turned OFF after the trailing edge of the sheet S has passed the nip portion of the sheet feeding roller 51 and the separation roller 53 of the separation feeding unit, as illustrated in FIG. 3I. Then, the driving of the sheet feeding roller 51 and of the separation roller 53 is cut off.

In steps S12 and S13, a predetermined time T3 (sec) has elapsed after the pre-registration sensor 58 is turned OFF, and, in step S14, the registration motor M2 is stopped after the trailing edge of the sheet S has passed the nip portion of the registration roller pair 57.

In step S15, a similar operation is repeated until a predetermined number of sheets have been processed. When the predetermined number of sheets have been processed (YES in step S15), in step S16, the sheet feeding motor M1 is stopped to complete the feeding operation.

As described above, a sheet at rest after having abutted the nip portion of the registration roller pair 57 is conveyed into the nip portion as the registration roller pair 57 rotates, and, simultaneously with this conveyance, the pressurization plate 70 brings the same sheet into press contact with the sheet feeding roller 51 to apply a conveyance force to the sheet. Thus, there is obtained a conveyance force large enough to convey the sheet that is being conveyed by the sheet feeding roller 51, thereby making it possible to prevent generation of defective conveyance.

In the first exemplary embodiment, the conveyance path 59 from the sheet feeding roller 51 to the registration roller pair 57 is of a curved configuration, so that, at the time of formation of a loop in the sheet, a large force is exerted from the sheet to separate the separation roller 53 from the sheet feeding roller 51.

Thus, the sheet conveyance force is reduced between the separation roller 53 and the sheet feeding roller 51, however, the sheet is pressed against the sheet feeding roller 51 by the pressurization plate 70, whereby a sheet conveyance force is obtained, making it possible to reliably eliminate such defective conveyance as occurred in the prior art.

Figure 6:
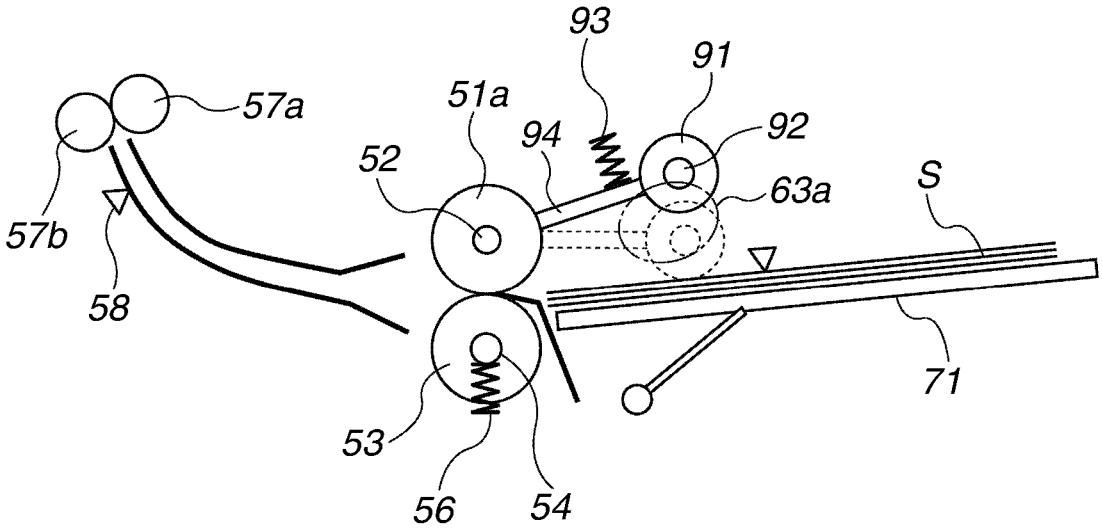
FIG. 6 is a sectional view of a sheet feeding apparatus according to a second exemplary embodiment of the present invention.
Figure 7:
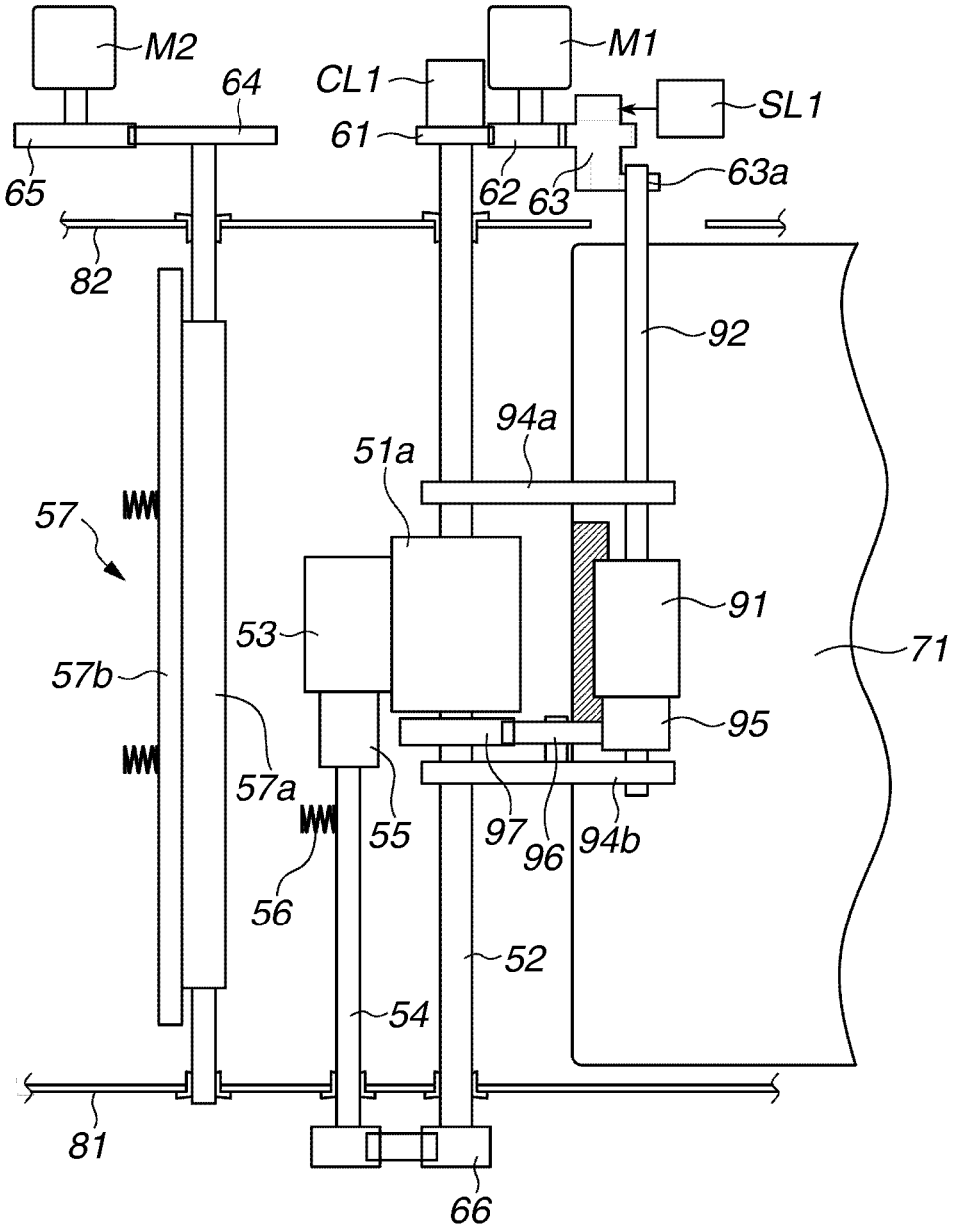
FIG. 7 is a developed view of driving mechanism of the sheet feeding apparatus according to the second exemplary embodiment of the present invention.

Next, a second exemplary embodiment of the present invention will be described. FIG. 6 is a sectional view of a sheet feeding apparatus 104 according to the second exemplary embodiment, and FIG. 7 is a developed view of the driving mechanism of the sheet feeding apparatus 104 of the second exemplary embodiment. Herein, only the differences from the first exemplary embodiment will be described in detail, and a description of the configuration not similar to those of the first exemplary embodiment will be omitted.

A printer main body 101 is provided with a sheet feeding tray 71 on which a sheet bundle S is stacked and supported, with the sheet feeding tray 71 being vertically swingable. The sheet feeding tray 71 is vertically movable due to a lifter mechanism 85 connected to a motor (not illustrated).

A sheet surface detection sensor 87 is provided above the sheet feeding tray 71 so as to be capable of detecting the uppermost surface of the sheets S. In a case where the sheet surface detection sensor 87 does not detect the sheet uppermost surface, a control unit C operates the lifter mechanism 85 to raise the sheet tray 71, maintaining the sheet uppermost surface at a predetermined height.

A pickup roller 91 configured to feed out sheets is provided so as to be swingable via a rocking member 94 (94*a*, 94*b*), using a support shaft 52 of a feed roller 51*a* as a fulcrum. The pickup roller 91 is urged clockwise in FIG. 6 by a spring 93 so as to pressurize the sheets S.

Since the uppermost surface of the sheets stacked on the sheet feeding tray 71 is maintained substantially at a fixed height, the pickup roller 91 can abut the sheets substantially with the same pressure (sheet feeding pressure) by the pressurization force of the spring 93.

Here, the pickup roller 91 is brought into press contact with the sheets S (as indicated by the broken line in FIG. 6) and is brought out of press contact therewith (as indicated by the solid line in FIG. 6) as appropriate by a pressurization unit employing a mechanism similar to that of the first exemplary embodiment. In other words, a construction similar to the cam 63*a* provided on the gear 63 illustrated in FIG. 2 is adopted.

Through rotation of the cam 63*a*, the cam 63*a* is brought into sliding contact with an end portion of the drive shaft 92 of the pickup roller 91 to push up the drive shaft 92, making it possible to raise the pickup roller 91 against the elastic force of the spring 93.

Further, driving is transmitted from a gear 97 fixed to a support shaft 52 of the feed roller 51*a* to a gear 95 fixed to the pickup roller 91 via a gear 96. Otherwise, the present exemplary embodiment is of the same construction as the first exemplary embodiment.

The pickup roller 91, the spring 93, the solenoid SL1, the cam 63*a* constitute the conveyance force imparting unit according to the second exemplary embodiment of the present invention.

Figure 5:
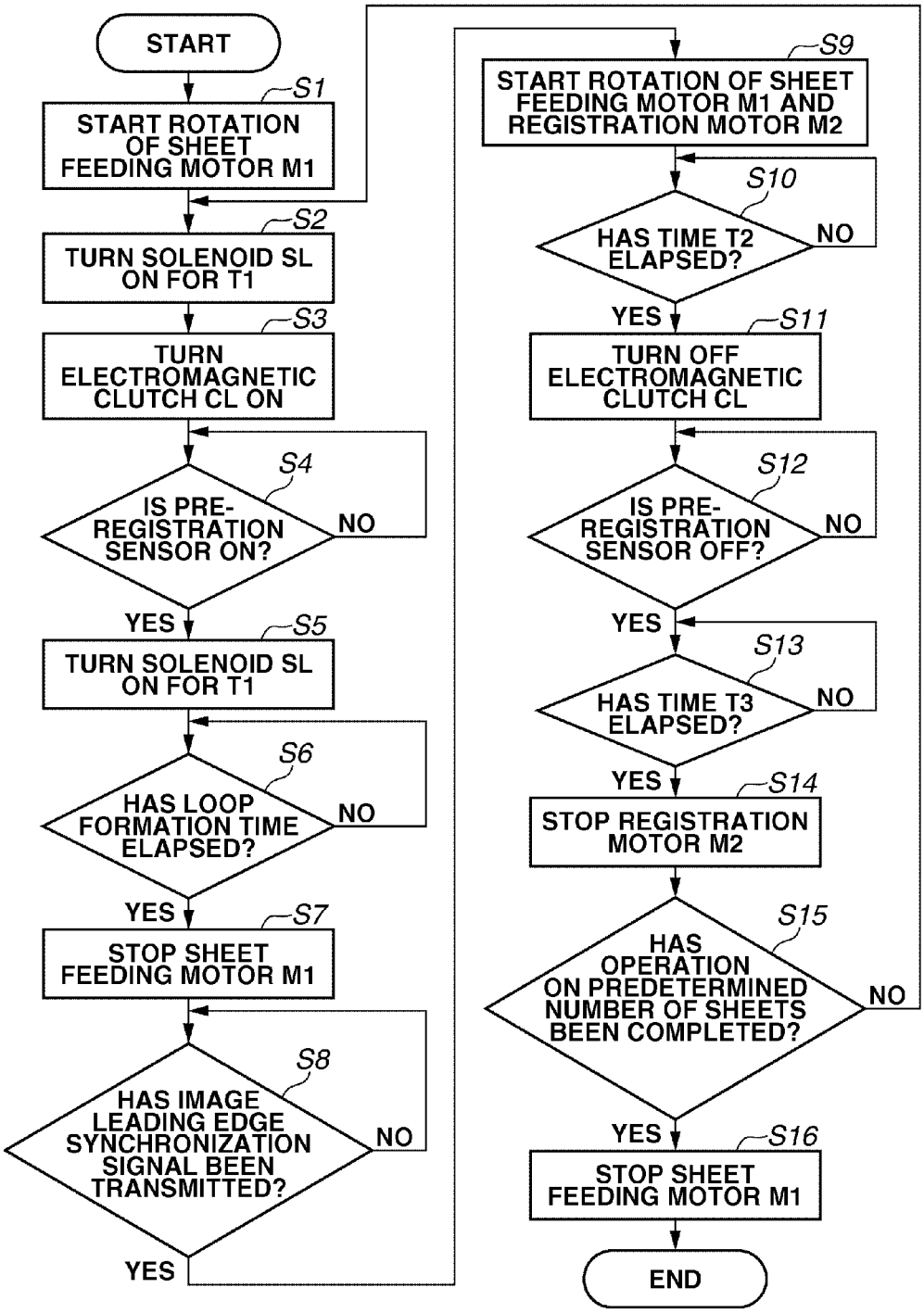
FIG. 5 is a flowchart illustrating the operation of the sheet feeding apparatus according to the first exemplary embodiment of the present invention.

As for the basic operation, since it is similar to that of the first exemplary embodiment, the operation of feeding sheets from the sheet feeding apparatus 104 will be schematically described with reference to the control block diagram of FIG. 5, and the flowchart of FIG. 6.

In step S1, when, with the sheets S stacked on the sheet feeding tray 71, a start button (not illustrated) is pressed, the control unit C causes the sheet feeding motor M1 to start to rotate.

Next, in step S2, the control unit C turns ON the solenoid SL1 for a time T1 (sec), and one-rotation control is started on the gear 63 and the cam 63*a* provided integrally with the gear 63. Through this operation, the pickup roller 91 is lowered to be brought into press contact with the sheet S supported by the pressurization plate 70.

In this state, in step S3, the control unit C turns ON the electromagnetic clutch CL1, and the sheet feeding apparatus starts sheet feeding. Further, through one-rotation control of the cam 63*a*, the pickup roller 91 is pushed up, and the pressurization of the sheet S on the feed roller 51*a* is released.

In this connection, the number of teeth of the gear 63 and the configuration of the cam 63*a* are determined so that the pressurization of the pickup roller 91 on the sheet is released immediately after the sheet S has entered the nip portion (press contact portion) between the feed roller 51*a* and the separation roller 53 constituting the separation portion.

In this way, immediately after the sheet has entered the nip portion between the feed roller 51*a* and the separation roller 53, the press contact between the pickup roller 91 and the sheet S is released. Thus, as in the prior art, it is possible to obtain a separation function by the separation roller 53, making it possible to return the double-fed sheet.

Through the above operation, the sheet S is conveyed by the feed roller 51*a* toward the nip portion of the registration roller pair 57 at rest. In the vicinity on the upstream of the registration roller pair 57, a pre-registration sensor 58 is arranged, and, in step S4, the pre-registration sensor detects the leading edge of the conveyed sheet S.

In step S5, when the pre-registration sensor 58 detects the leading edge of the sheet (YES in step S4), the solenoid SL1 is turned ON, and the rotation of the sheet feeding motor M1 is transmitted to the cam 63*a*, so that the pickup roller 91 is lowered by the spring 93 to be brought into press contact with the sheet S being conveyed.

On the other hand, in step S6, the sheet feeding roller 51*a* is kept rotating until a predetermined period of time has elapsed after the detection of the leading edge of the sheet by the pre-registration sensor 58, whereby the sheet is fed even after the leading edge of the sheet abuts the nip portion of the registration roller pair 57 at rest. Thus, in step S7, a loop is properly formed in the sheet on the upstream of the registration roller pair 57, and the sheet feeding motor M1 is stopped.

In this connection, the timing at which the solenoid SL1 is turned ON is set so that the timing at which the solenoid SL1 is turned ON to cause the pickup roller 91 to abut the sheet, is substantially the same as the timing at which the loop is formed in the sheet to stop the feed roller 51*a*.

As a result, with the pickup roller 91 held in press contact with the sheet being conveyed, the feed roller 51*a* stops, and the start of the driving of the registration roller pair 57 is waited for. By thus setting the timing, the pickup roller 91 is held in press contact with the sheet S that is being conveyed at the rotation start of the registration motor M2.

Through this control, the pickup roller 91 is held in press contact with the sheet S at the time of loop formation. An image leading edge synchronization signal is issued from the secondary transfer roller 118 or the laser scanner unit 111 for image exposure (YES in step S8), and, in step S9, the rotation of the sheet feeding motor M1 and of the registration motor M2 is started again.

As a result, the registration roller pair 57 rotates to convey the sheet, and, at the same time, the pickup roller 91 starts sheet feeding, so that the sheet S is conveyed again by the pickup roller 91. Further, through one-rotation control of the cam 63*a*, the press contact of the sheet S by the pickup roller 91 is released after the conveyance by a predetermined amount. As a result, the sheet to be fed out and the next sheet are not drawn out together due to a frictional force to cause double-feeding.

In step S10, a predetermined period of time T1 (sec) has elapsed after the re-conveyance of the sheet S, and, in step S11, the electromagnetic clutch CL1 is turned OFF after the trailing edge of the sheet S has passed the nip portion between the feeding roller 51*a* and the separation roller 53.

As a result, the driving of the feeding roller 51*a* and the separation roller 53 is cut off. In steps S12 and S13, a predetermined period of time T3 (sec) has elapsed after the pre-registration sensor 58 is turned OFF, and, in step S14, the registration motor M2 is stopped after the trailing edge of the sheet S has passed the nip portion of the registration roller pair 57.

In step S15, a similar operation is repeated until a predetermined number of sheets have been processed. In step S16, when the predetermined number of sheets have been processed, the sheet feeding motor M1 is stopped to end the feeding operation.

As described in detail above, the sheet abuts the nip portion of the registration roller pair 57 and stops there to form a loop in a predetermined amount, and is then conveyed into the nip portion as the registration roller pair 57 rotates. At this time, the sheet that is being conveyed is fed by the pickup roller 91. Thus, due to the pickup roller 91, a conveyance force large enough to convey the sheet that is being conveyed is obtained, making it possible to prevent generation of defective conveyance.

Further, in the present exemplary embodiment, the conveyance path 59 between the feeding roller 51*a* and the registration roller pair 57 is of a curved configuration, so that, when a loop is formed in the sheet, a large force is exerted so as to separate the separation roller 51*a* from the feeding roller 51*a*. Thus, defective conveyance is likely to occur, however, in the present exemplary embodiment, it is also possible to eliminate this problem.

Although in the above exemplary embodiments a conveyance force is imparted to the sheet in response to the detection of the sheet by the pre-registration sensor, this should not be construed restrictively.

There are no limitations regarding the method of imparting the conveyance force so long as a conveyance force is imparted to the sheet by the conveyance force imparting unit when the sheet enters the nip portion of the registration roller pair.

For example, when sheet feeding operation is performed based on a signal from the start button of the printer, a signal from an external apparatus such as a personal computer, the sheet feeding motor M1 may start rotation, and impart a conveyance force to the sheet based on the count value as counted from the moment when the solenoid SL1 is turned ON by the control unit C.

That is, the counting on the counter is started when the solenoid SL1 is turned ON. When the counter counts a count value at which the leading edge of the sheet being fed is expected to reach a position that is a predetermined amount before the nip portion of the registration roller pair 57 (e.g., the position where the pre-registration sensor 58 is arranged), the solenoid SL1 is turned ON again.

Further, when the counter counts a count value at which the sheet is expected to abut the nip portion of the registration roller pair 57 to form a loop in a predetermined amount, the sheet feeding motor M1 is stopped.

As a result, a conveyance force is applied to the sheet in a state where the leading edge of the sheet has abutted the nip portion of the registration roller pair 57 to form a predetermined loop, and the rotation start of the registration roller pair 57 is waited for.

And, when the registration roller pair 57 starts to rotate in conformity with the image formation timing of the image forming unit, the sheet feeding motor M1 also starts to rotate, and a conveyance force is applied to the sheet to assist the sheet feeding, thus effecting conveyance reliably.

In the case of a sheet whose rigidity is higher than a predetermined value such as in the case of an envelope or a postcard, the registration roller pair may fail to catch the leading edge of the sheet, thus making the conveyance impossible. In view of this issue, in the present exemplary embodiment, a conveyance force is applied to the sheet by the conveyance force imparting unit. In the case of a sheet whose rigidity is less than a predetermined value, no defective conveyance occurs, so that a conveyance force may not need to be applied to the sheet by the conveyance force imparting unit.

This control will be described. At least one item of sheet information regarding the rigidity of the sheet, such as the kind of sheet for image formation (cut sheet, envelope, postcard, etc.), thickness, and basic weight, is input to the control unit C from an external apparatus such as the input monitor of the printer or a personal computer.

Based on the input sheet information, the control unit C determines whether or not to impart a conveyance force to the sheet by the conveyance force imparting unit. The control unit C stores data for determining whether or not to impart a conveyance force to the sheet by the conveyance force imparting unit based on the kind of sheet (cut sheet, envelope, postcard, etc.), thickness, basic weight.

This data is a table that can determine whether the sheet rigidity is not less than or less than a predetermined value from the kind of sheet (cut sheet, envelope, postcard, etc.), thickness, basic weight, etc.

The control unit C determines the rigidity of the sheet based on information such as the kind of sheet (cut sheet, envelope, postcard, etc.), thickness, basic weight, etc. And, when the sheet rigidity is larger than a predetermined value, the control unit C controls the conveyance force imparting unit to impart a conveyance force to the sheet when the registration roller pair 57 starts sheet conveyance, thus conveying the sheet reliably.

Generally speaking, an envelope and a postcard are of high rigidity, so that a conveyance force may be imparted to the sheet by the conveyance force imparting unit only when information indicating envelope and postcard is input to the control unit C, and may not be imparted in the case of other kinds of sheets.

Although, in the exemplary embodiments described above, the separation roller driven in a direction reverse to the sheet feeding direction as the separation portion of the separation feeding unit is described as an example, however, this should not be construed restrictively, and it is also possible to adopt a separation pad or a separation roller using no driving.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-154960 filed Jul. 7, 2010, which is hereby incorporated by reference herein in its entirety.

What is claimed is:

1. An image forming apparatus including a sheet feeding apparatus which feeds the sheet and an image forming unit which forms an image to the sheet fed out from the sheet feeding apparatus, the image forming apparatus comprising:

a sheet stacking portion configured to stack sheets;

a separation-feeding unit configured to separate and feed the sheets stacked on the sheet stacking portion;

a conveyance force imparting unit configured to impart a conveyance force to the sheets on the upstream in the sheet feeding direction of the separation-feeding unit;

a registration roller pair arranged on the downstream in the sheet feeding direction of the separation-feeding unit and configured to feed out a sheet to the image forming unit at a predetermined timing after temporarily stopping the sheet, with its leading edge abutting a nip portion; and a control unit configured to control an operation of the separation-feeding unit, of the conveyance force imparting unit, and of the registration roller pair, wherein the control unit performs control so that after the conveyance force imparting unit has applied a conveyance force to the sheet to enter the separation-feeding unit, the imparting of the conveyance force to the sheet by the conveyance force imparting unit is stopped, that the sheet is conveyed to the registration roller pair at rest by the separation-feeding unit to cause the leading edge of the sheet to abut the nip portion, and that when the registration roller pair starts to rotate, the sheet is fed again by the separation-feeding unit, with the conveyance force being imparted to the sheet by the conveyance force imparting unit.

2. The image forming apparatus according to claim 1, wherein the separation-feeding unit is formed by a sheet feeding roller and a separation portion held in press contact with the sheet feeding roller, wherein the conveyance force imparting unit has a pressurization plate provided so as to be swingable and configured to press the sheet stacked on the sheet stacking portion against the sheet feeding roller, and wherein the pressurization plate imparts a conveyance force to the sheet by pressing the sheet against the sheet feeding roller.

3. The image forming apparatus according to claim 2, wherein the pressurization plate is urged toward the sheet feeding roller by a spring, and is pushed down against the elastic force of the spring by a rotatable cam to be thereby separated from the sheet feeding roller, and wherein the control unit controls the rotation of the cam so that, when the sheet feeding roller feeds again the sheet that has abutted the nip portion of the registration roller pair, the pressurization plate is urged toward the sheet feeding roller by the spring to keep the sheet at rest in a state urged toward the sheet feeding roller.

4. The image feeding apparatus according to claim 1, wherein the separation-feeding unit is formed by a sheet feeding roller and a separation portion held in press contact with the sheet feeding roller, and wherein the conveyance force imparting unit has a pickup roller configured to abut the sheet stacked on the sheet stacking portion to feed the sheet to a press contact portion between the sheet feeding roller and the separation portion, and the pickup roller abuts the sheet and rotates to thereby apply a conveyance force to the sheet.

5. The image forming apparatus according to claim 4, wherein the pickup roller is urged toward the sheet stacked on the sheet stacking portion by a spring and is pushed up by a rotatable cam against the elastic force of the spring to thereby separate from the sheet, and wherein the control unit controls the rotation of the cam so that, when the sheet feeding roller feeds again the sheet that has abutted to the nip portion of the registration roller pair, the cam stops, in a state where the pickup roller is urged toward the upper surface of the sheet stacked on the sheet stacking portion by the spring.

6. The image forming apparatus according to claim 1, wherein the control unit performs control so as to impart a conveyance force to the sheet by the conveyance force imparting unit when the input sheet rigidity is not less than a predetermined value, and does not impart a conveyance force by the conveyance force imparting unit when the sheet rigidity is less than the predetermined value.

7. The image forming apparatus according to claim 1, wherein, when input sheet information indicates an envelope or a postcard, the control unit performs control so as to impart a conveyance force to the sheet by the conveyance force imparting unit, and does not impart any conveyance force by the conveyance force imparting unit in the case of a sheet other than that.

8. The image forming apparatus according to claim 1, further comprising a detection unit provided on the upstream in the sheet conveyance direction and in the vicinity of the registration roller pair and configured to detect a sheet, wherein the control unit performs control so that the conveyance force imparting unit imparts a conveyance force to the sheet that has abutted the registration roller pair based on sheet detection by the detection unit.

* * * * *